US006923098B2

(12) United States Patent
McGarvey et al.

(10) Patent No.: US 6,923,098 B2
(45) Date of Patent: Aug. 2, 2005

(54) METHOD AND APPARATUS FOR INSPECTING AND CUTTING ELONGATED ARTICLES

(75) Inventors: Kenneth James McGarvey, Walla Walla, WA (US); Robert Earl Jones, Milton-Freewater, OR (US); Maurice Jarold Hunking, Walla Walla, WA (US)

(73) Assignee: Key Technology, Inc., Walla Walla, WA (US)

( * ) Notice: Subject to any disclaimer, the term of this patent is extended or adjusted under 35 U.S.C. 154(b) by 25 days.

(21) Appl. No.: 10/466,718

(22) PCT Filed: Jan. 23, 2001

(86) PCT No.: PCT/US01/02327

§ 371 (c)(1),
(2), (4) Date: Jul. 18, 2003

(87) PCT Pub. No.: WO02/058899

PCT Pub. Date: Aug. 1, 2002

(65) Prior Publication Data

US 2004/0094006 A1 May 20, 2004

(51) Int. Cl.[7] ..... B26D 5/34; B26D 7/32

(52) U.S. Cl. ..... 83/13; 83/76.8; 83/303; 83/337; 83/371; 83/932

(58) Field of Search ..... 83/13, 76.8, 303, 83/337, 371, 932, 75.5, 286–289, 363–365, 732, 418, 37, 155, 72, 74, 104, 293, 155.1, 315, 338, 368; 234/50; 209/539, 540; 250/221.1, 559.11; 198/446, 382

(56) References Cited

U.S. PATENT DOCUMENTS 3,120,922 A 2/1964 Waldrum
3,946,116 A * 3/1976 Weaver et al. ..... 426/103
4,164,294 A * 8/1979 Johnson ..... 414/808
4,186,836 A * 2/1980 Wassmer et al. ..... 209/565
4,385,700 A 5/1983 Hodges et al.
4,485,912 A 12/1984 Carmichael et al.
4,520,702 A 6/1985 Davis et al.
4,576,071 A 3/1986 Rayment
4,655,110 A 4/1987 Cowlin et al.
4,656,904 A 4/1987 Rayment
5,000,569 A * 3/1991 Nylund ..... 356/237.1
5,235,880 A 8/1993 Wilbur et al.
6,220,134 B1 * 4/2001 Thiel et al. ..... 83/74

* cited by examiner

*Primary Examiner*—Boyer D. Ashley
(74) *Attorney, Agent, or Firm*—Wells St. John P.S.

(57) ABSTRACT

A cutting wheel assembly for cutting elongated articles having a cylindrical housing which defines a longitudinal cavity and a circular outer periphery. A plurality of cutting blade support rings are rotatably mounted about the outer periphery of the housing. A plurality of cutting blades are mounted for radial movement on each ring and disposed at angularly spaced increments about the housing, wherein each blade is moveable between a first, non-cutting position and a second, cutting position. A manifold and valve assembly is mounted in the cavity and proximate the blades for selectively directing a pulse of fluid against individual blades at preselected angular positions to urge the blades outwardly from the non-cutting position to the cutting position. A plurality of camming components are positioned about the periphery of the housing and secured against rotation adjacent the rings. The camming components include tracking grooves for receiving portions of the blades which guide the blades along the cutting and non-cutting positions, and which maintain the blades in the cutting position without continued presence of the fluid.

10 Claims, 18 Drawing Sheets

302c
350c
303c 302b
350b
303b 302a
350a
303a

METHOD AND APPARATUS FOR INSPECTING AND CUTTING ELONGATED ARTICLES

CROSS REFERENCE TO RELATED APPLICATION

This application is a 35 U.S.C. §371 of PCT International Application Number PCT/US01/02327, which was filed 23 Jan. 2001 (23.01.01), and was published in English.

TECHNICAL FIELD

This invention relates to inspection and cutting apparatuses for removing defects and length cutting or sizing a stream of moving elongated articles, and to cutting wheel assemblies, and methods for utilizing same.

BACKGROUND ART

The food processing industry continues to devise high production systems for the inspection of food products such as potatoes to ensure the quality desired, length, and removal of substantially all defective pieces from a stream of product such as raw potato strips which are being processed into french fries. Historically, defect removal and quality control in the food processing industry has been labor intensive and dependent upon and limited by the viability of the work force. The frequency and severity of defects in the raw product is highly variable depending upon local factors affecting crops. Accordingly, food processors must process large quantities of raw product through different stages to be cost effective, including sorting to remove defective pieces and inspection for product quality. The industry has sought to replace manual methods with automated systems to achieve higher yield, better product quality and reduced costs. Accordingly, one industry strategy is to provide automated inspection and cutting systems.

Inspection and cutting systems have been constructed for optically inspecting elongated articles, and for separating the articles based upon whether the optical information indicates that the article contains a defect. An exemplary inspection and cutting apparatus and method for same is illustrated in U.S. Pat. No. 4,520,702 granted to Davis et al. on Jun. 5, 1985, and which is incorporated herein by reference. While the Davis apparatus has served the industry well, the market continues to demand improved product yield where more of the good product is recovered; improved quality where a higher percentage of defective product is being removed; and with both of these improvements to further handling of the product at greater speeds of processing. However, limitations of previous apparatuses and methods have impeded the food processing industry from reaching these goals, and therefore, the industry continues to strive to improve their existing methods of processing.

For example, the Davis apparatus uses a rotating cutting mechanism that houses cutting devices selectively driven by water to partially extend the cutting devices from the cutting mechanism to cut elongated articles moving on a conveyor. To increase processing speeds, the angular velocity of the cutting mechanism must increase. However, such increased angular velocity exerts inertia forces on the cutting devices which has the effect from time to time of indiscriminately moving the cutting devices to extend from the cutting mechanism and potentially inadvertently cut quality product. Accordingly, product yield and quality are diminished. In view of the foregoing, it would be highly desirable to provide methods and apparatuses which address this perceived shortcoming.

In addition to the foregoing, the Davis apparatus relies upon a system of valves and conduits to supply water for delivering a pulse of water to drive the cutting devices for cutting product. However, moving such a mass of water with valves positioned a distance from the cutting device is perceived to limit processing speeds because moving the necessary volume of water proved to be relatively slow for increasing the speed of food processing. Moreover, the valves and water used in previous methods and apparatuses proved unsatisfactory because it was difficult to drive individual cutting devices. This appeared to be due to the fact that the duration of a pulse of water could not be shortened to drive only one cutting device. As a result, two cutting devices were sometimes activated where one would have been more beneficial. Furthermore, increasing the angularly velocity of the cutting mechanism would only exacerbate this limitation. Accordingly, product yield and quality were diminished.

Another disadvantage resulting from not being able to selectively activate one cutting device is that length cutting is less productive if a section of an elongated article is removed for sizing due to two cutting devices being driven when one will suffice. In view of the foregoing, it would be highly desirable to provide methods and apparatuses for selectively activating only one cutting device when desired.

Yet further, the Davis apparatus did not detect elongated articles clumped together, that is, two or more elongated articles contacting one another during the cutting process. Accordingly, if a clump of several elongated articles are clumped together with only one having a defect, and a cutting device is activated to cut the defect, the other quality elongated articles could be inadvertently cut.

In view of the foregoing, it would be highly desirable to provide methods and apparatuses for improving the apparatus and method of the prior art, and to further provide a method and apparatus for improving the selective removal of defects from elongated articles.

BRIEF DESCRIPTION OF THE DRAWINGS

Preferred embodiments of the invention are described below with reference to the following accompanying drawings.

FIG. 9 is a fragmentary exploded, perspective view of a cutting mechanism of the present invention without the manifold and valve assembly.

FIG. 10 is a perspective view of the cutting mechanism according to one embodiment of the present invention.

FIGS. 14A and 14B together define a flowchart illustrating a first logic method of the present invention and which is performed by the central processing unit of FIG. 13 to control the inspection and cutting apparatus of FIG. 1 for length cutting and defect removal of elongated articles.

FIGS. 16A–C are simplified illustrations of orientations of elongated articles such as french fries that would be classified as clumps according to the inspection and cutting apparatus of the present invention.

FIGS. 17A–C are simplified illustrations of orientations of elongated articles such as french fries that would be classified as clumps according to the inspection and cutting apparatus of the present invention.

FIGS. 18A–E are simplified illustrations of elongated articles such as french fries and which are oriented to illustrate a method of the invention which generates cusp pixels.

BEST MODES FOR CARRYING OUT THE INVENTION AND DISCLOSURE OF INVENTION

Reference will now be made to preferred embodiments of Applicants' invention, and while the invention is described by way of referred embodiments, it is understood that the description is not intended to limit the invention to these embodiments, but is intended to cover alternatives, equivalents and modifications such as are intended within the scope of the attended claims.

In an effort to prevent obscuring the invention at hand, only details germane to implementing the invention will be described in great detail, with presently understood periphery details being incorporated by reference (for example to Davis '702) as needed, as being presently understood in the art.

Figure 1:
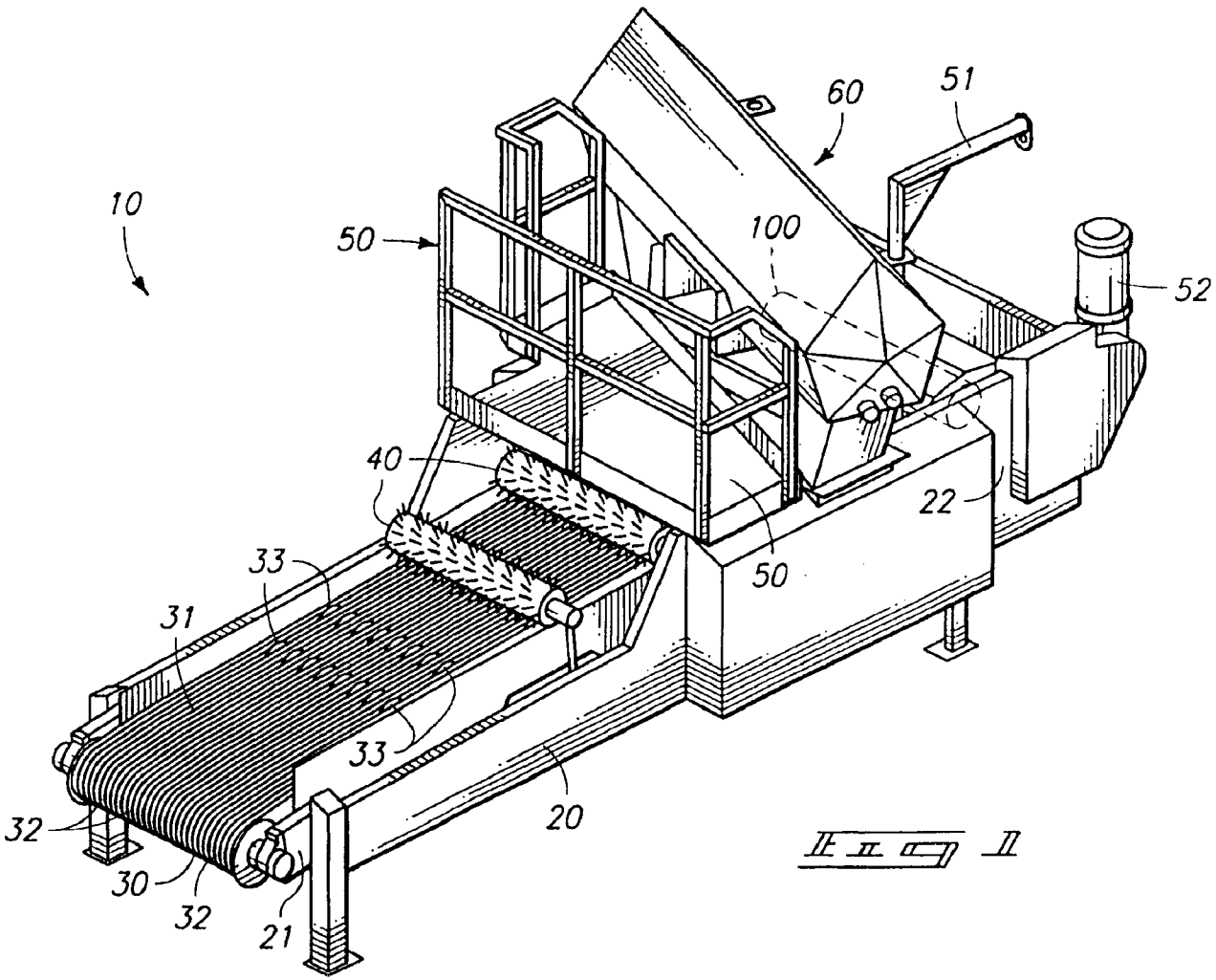
FIG. 1 is a perspective view of one form of the inspection and cutting apparatus of the present invention.

An inspection and cutting apparatus is best seen in FIG. 1, and is generally indicated by numeral 10. Apparatus 10 of the subject invention is operable for visually inspecting elongated articles such as raw potato strips or sticks to determine if the elongated articles or strips have color or other shade variation defects therein; to remove the defect; and to cut each strip as to length while it travels in a stream of product. As should be understood, shade variation defects are perceived to be detrimental to the quality of the resulting product. Throughout the description, reference will be made to the processing of elongated articles such as french fries. However, it should be understood that other types of elongated articles or products such as green beans, having color or other shade variation defects or differentiations, may be processed utilizing the same apparatus 10. The apparatus 10 is particularly useful for high volume processing in which even small increases in salvageable product have significant economic benefits.

Referring now to apparatus 10, a frame 20 includes a forward end 21 and a rearward end 22. An elongated article conveyor 30 is movably mounted on the frame 20 and extends from the forward end 21 to the rearward end 22 of frame 20 (rearward portion of conveyor 30 is blocked from view by frame 20 structure). The article conveyor 30 provides a relatively wide, moving, elongated article supporting surface 31. Supporting surface 31 receives the elongated articles and generally aligns them longitudinally into a plurality of transversely spaced lanes. The articles are moved by the conveyor past an inspection device generally designated with the numeral 60, described hereinafter, and then past a cutting mechanism generally designated with the numeral 100, and which is described hereinafter (shown in phantom). It should be understood that the conveyor 30 is operable for movement in a direction from the forward end or infeed 21 to the rearward end or outfeed 22 of frame 20. An exemplary conveyor 30 includes a plurality of belts 32 (only a few numbered). Each belt defines one of a plurality of transversely spaced lanes for receiving an elongated article and aligning it generally longitudinally. An exemplary number of belts 32 includes 28 lanes, or belts 32. However, it should be understood that the number of lanes, or belts 32 can be varied, as well as for the number of belts 32 designated for each one of the plurality of transversely spaced lanes.

Apparatus 10 further includes a plurality of rotatable disks 33 which extend upwardly between the lanes and which are substantially parallel to the direction of movement of the conveyor 30. These same disks are also seen with respect to FIG. 2. Apparatus 10 further includes at least one substantially cylindrical brush 40 which is secured above and substantially perpendicular to the direction of movement of the conveyor 30, and is further seen with reference to FIG. 2. Apparatus 10 further includes a cat walk 50 which is secured to frame 20 and located above the conveyor 30. The catwalk facilitates inspection and maintenance of apparatus 10. Apparatus 10 further includes a hoist assembly 51 which is secured to frame 20 and which is useful for removing the cutting mechanism 100 for inspection and maintenance. Apparatus 10 also includes a conveyor drive 52 which is secured to the frame 20 and which is operatively coupled in controlling relation relative to the conveyor 30 and which further is responsive to control circuitry which will be discussed in greater detail below.

Figure 2:
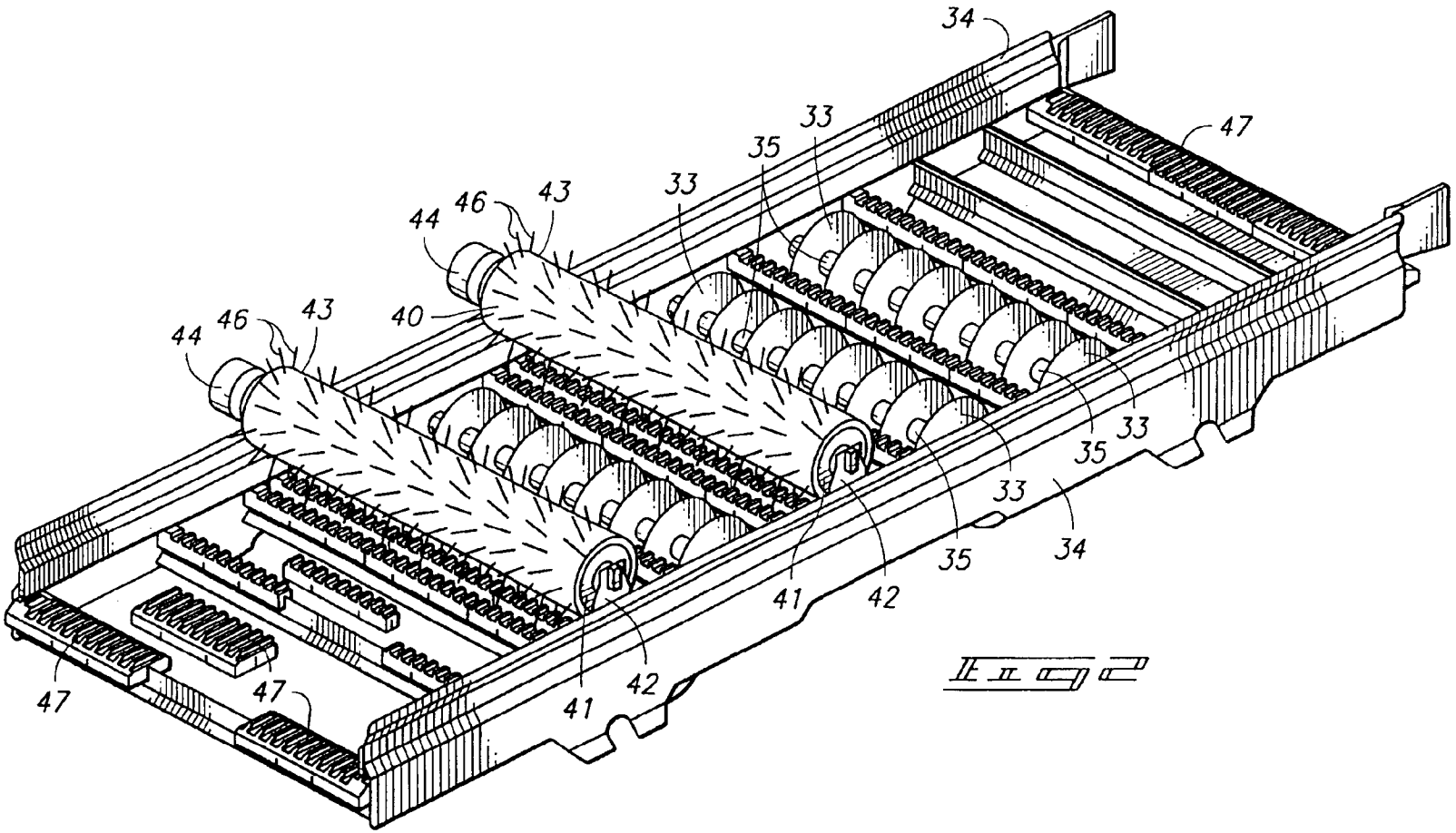
FIG. 2 is a partial perspective view of one form of a conveyor bed of the inspection and cutting apparatus of the present invention shown with some supporting surfaces removed.

Referring now to FIG. 2, brushes 40 and disks, or alignment washers 33 are more clearly shown. To prevent obscuring the invention at hand, a conveyor bed or belt frame 34 is illustrated without many supporting structures shown such as the frame 20, on which the conveyor bed 34 is secured, and with belts 32 also removed. A plurality of disks 33 are rotatably secured to shaft 35 which is, in turn, secured to the conveyor belt frame 34. The respective shafts 35 are oriented transversely relative to the direction of movement of conveyor 30. It should be understood that any number of disks 33 may be rotatably secured to one shaft 35, and any number of shafts 35 with disks 33 could be secured to the conveyor frame 34. Still further, brush 40 has a first end 41 which is rotatably secured to a support bracket 42, and a second end 43 opposite the first end 41. The second end 43 includes a motorized pulley 44 which facilitates the driving of the brush 40 in a rotational direction contrary to the movement of conveyor 30. Brush 40 includes an outer surface, or sleeve 45 with a plurality of bristles 46 extending therefrom. Bristles 46 are substantially aligned in a plurality of rows around brush 40, with an exemplary orientation of the rows defining a plurality of helical rows. However, it should be understood that other orientations of bristle 46 alignment around brush 40 could be used. Furthermore, other spacing orientations from one bristle 46 to the next could be used. Yet further while only one bristle 46 is shown to extend from a point on brush 40, it should be understood that a plurality of bristles 46 could extend from the same point on brush 40.

Conveyor bed frame 34 further includes a plurality of belt supports 47 for orienting and supporting the respective belts 32. With the brush 40 oriented above conveyor 30, bristles 46 extend radially outwardly from outer surface 45 to contact clumps of elongated articles, defined as two or more elongated articles contacting one another. As a clump moves into contact with bristles 46 of brush 40 on conveyor 30, the clump is dislodged or separated thereby singulating the respective elongaged articles. Furthermore, with disks 33 extending upwardly between the individual belts 32, the disks 33 facilitate singulation and alignment of the articles longitudinally as each article moves along the conveyor 30. Accordingly, nondefective articles clumped with defective articles are not inadvertently cut. This feature results in increased product yield and quality.

Figure 3:
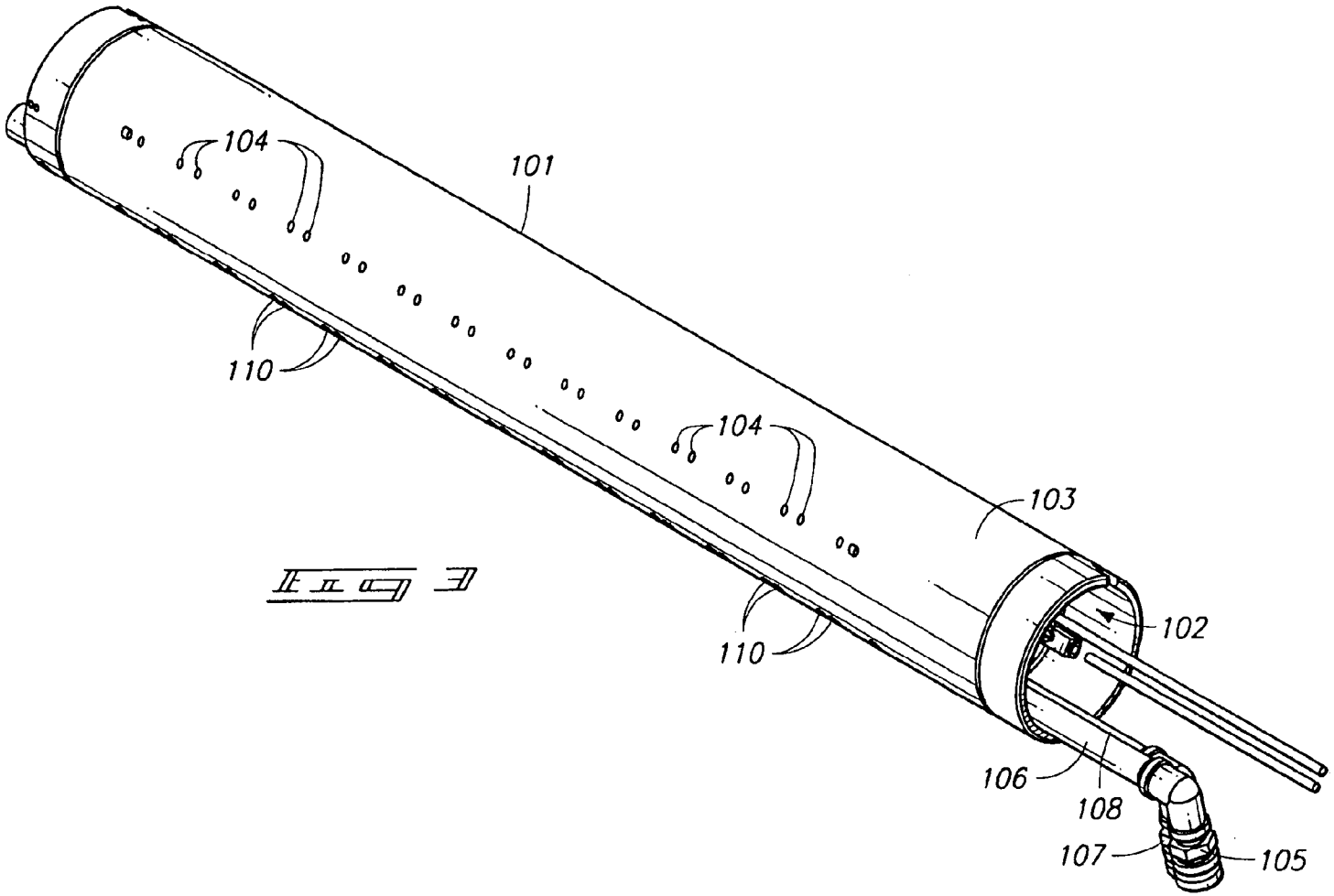
FIG. 3 is a perspective view of a cylindrical housing utilized in a cutting mechanism of the present invention.

Referring now to FIGS. 3–13, components of cutting mechanism 100 are seen in further detail. FIG. 3 illustrates a substantially cylindrical housing 101 defining a longitudinally disposed cavity 102, and which further has a substantially outer periphery or surface 103. Outer periphery 103 of cylindrical housing 101 defines a first plurality of dispersed orifices 104 that allow a fluid to exit and which drives individual cutting devices. A first spray bar assembly 105 includes a first tube 106 disposed longitudinally within cavity 102 and which supplies a fluid, for example water, to a camming component (which will be described hereinafter) through a second plurality of dispersed orifices 110 defined by cylindrical housing 101. A second spray bar assembly 107 includes a second tube 108 which is disposed longitudinally within cavity 102 to provide a fluid, for example water, to cutting device support rings (which will be described hereinafter) through the second plurality of dispersed orifices 110. It should be understood that the spray bar assemblies 105 and 107 further provide water to remove debris from the apparatus 10 while the apparatus is in operation. Additionally, the water can be further used to avoid the overheating and subsequent damage of any components of cutting mechanism 100 during operation.

Figure 4:
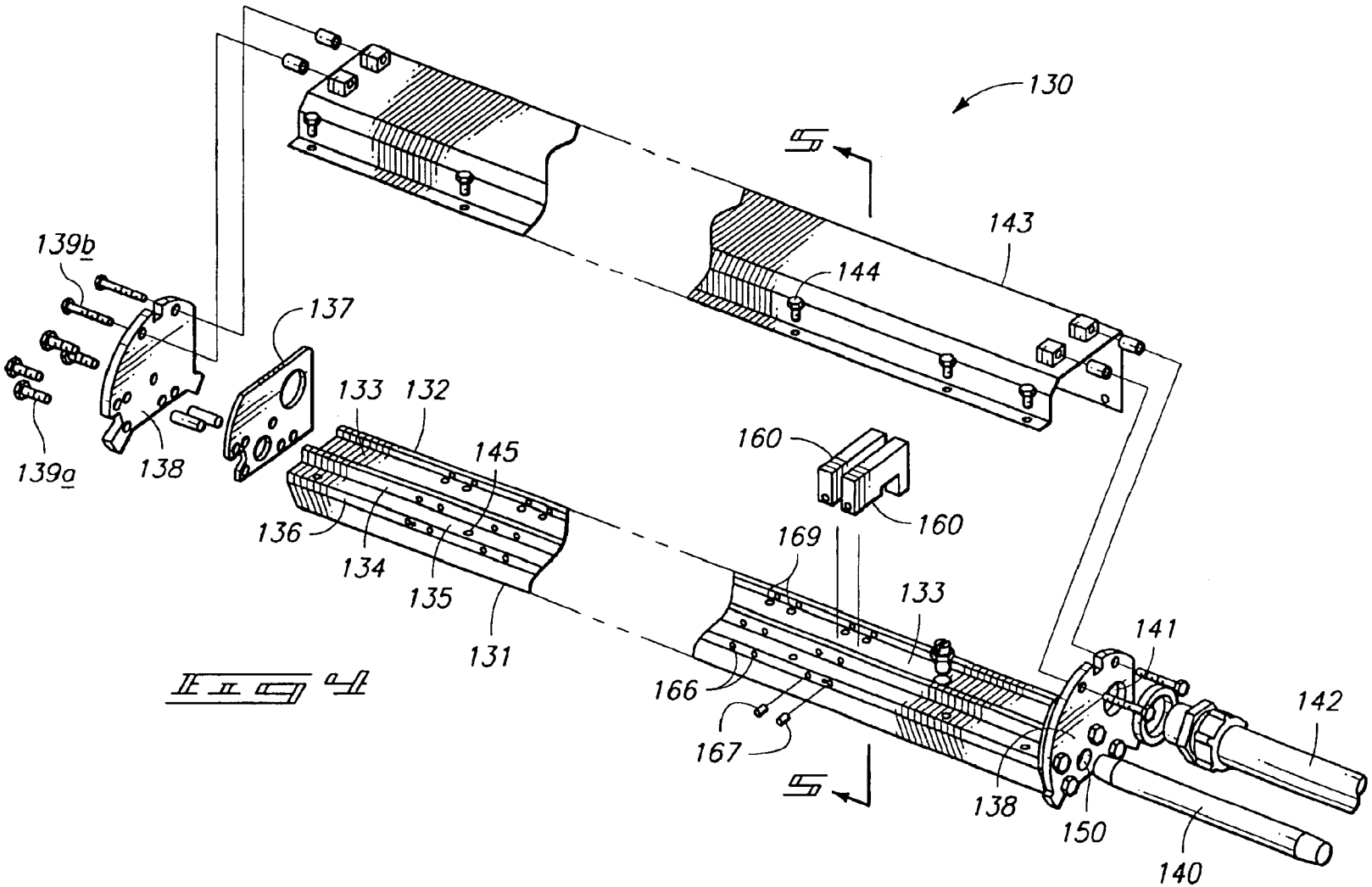
FIG. 4 is a fragmentary exploded, segmented, perspective view of a manifold and valve assembly of the present invention.

Referring now to FIG. 4, a manifold and valve assembly is generally indicated by numeral 130. Assembly 130 includes an elongated manifold member 131. Manifold member 131 defines a first ridge 132 which extends upward from an upper shelf 133; and a second ridge 134 which extends upward from the upper shelf 133 opposite to the first ridge 132. Manifold member 131 further includes an upwardly facing surface 135 which is located between the second ridge 134, and a front face which is designated 136. Manifold member 131 further defines a fluid chamber (not shown) that is fluidly sealed by a gasket 137 and end plate or element 138. Both the gasket and end plates are secured to each end of manifold member 131 by a plurality of bolts 139*a*. One end plate or element 138 and gasket 137 define aligned first openings or apertures 150 to receive a first conduit 140 which is connected to a fluid source, such as ambient air. The first conduit 140 provides the fluid to the manifold member 131. Adjacent to the first opening 150 are aligned second openings 141 to receive a second conduit 142. The second conduit houses electrical wiring for electrically coupling to a plurality of valves 160 (only two valves 160 are shown in FIG. 4). An exemplary valve 160 is a solenoid type which is commercially available from Mac Valves, Inc., P.O. Box 111, 30569 Beck Road, Wixon, Mich. 48393-7011. An exemplary valve would include a Mac 44 series, and accordingly, the inner workings of the valve 160 are not described. An environmental protective cover 143 to enclose manifold member 131 is secured to end plates or elements 138 by bolts 139*b* and upper surface 135 of manifold member 131 by bolts 144 into openings 145.

Figure 5:
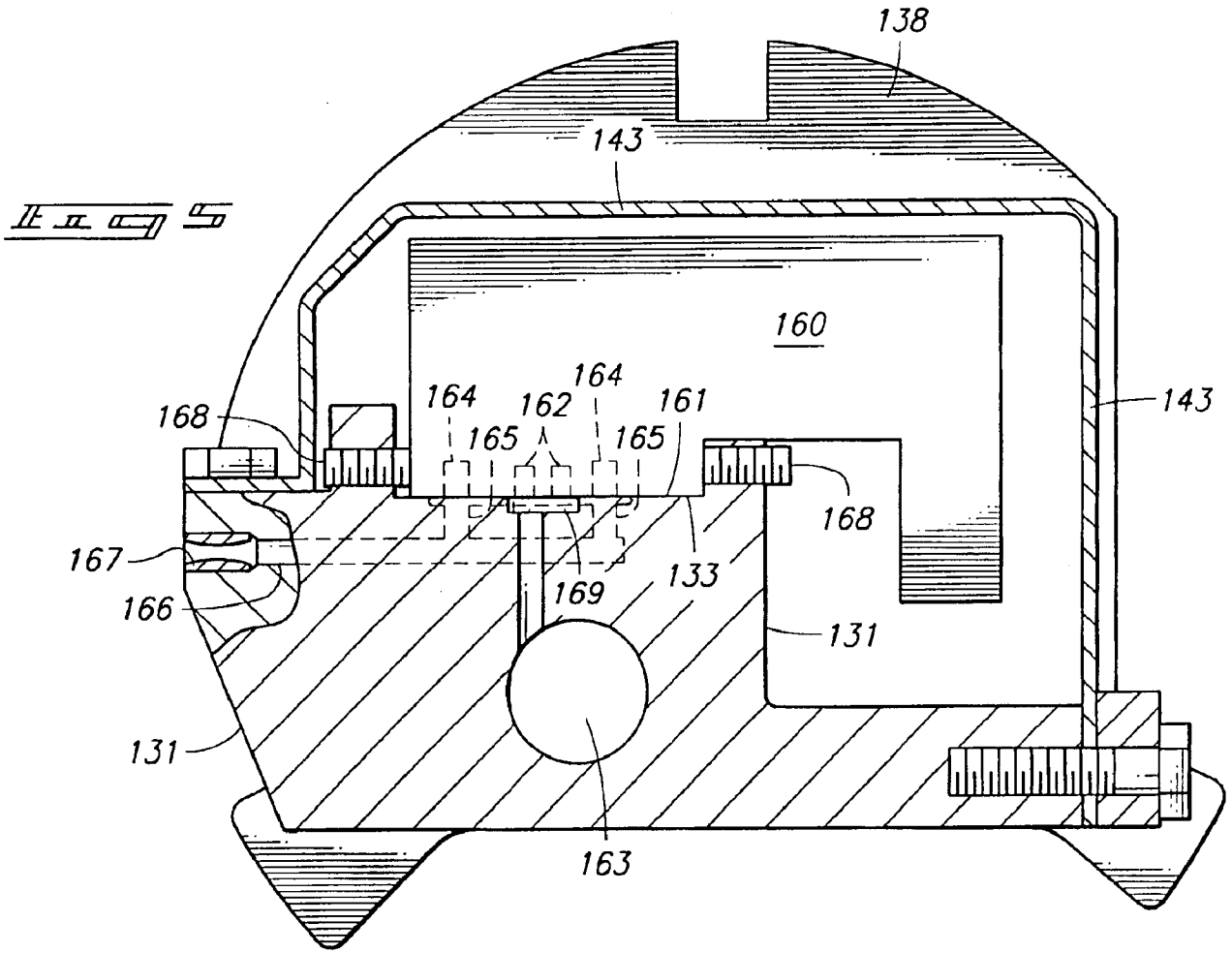
FIG. 5 is a sectional view of the manifold and valve assembly of the present invention and which is taken from a position along line 5—5 of FIG. 4.
Figure 6:
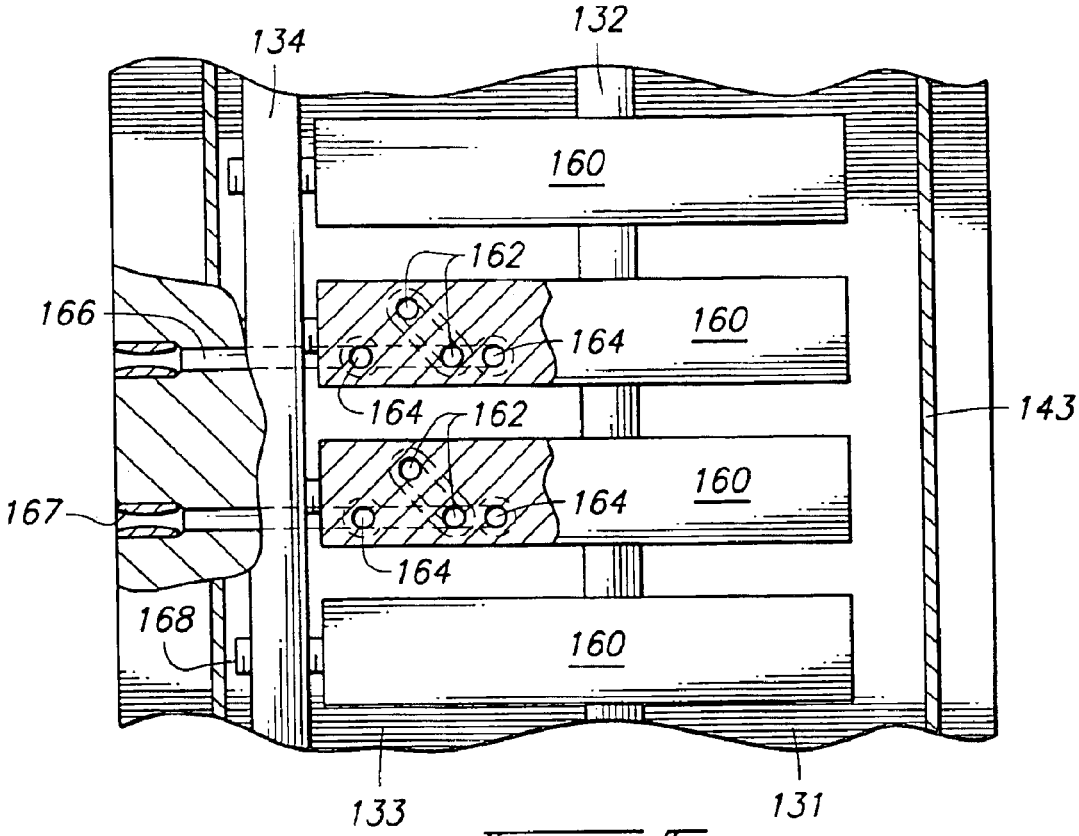
FIG. 6 is a partial, fragmentary, top plan view of the manifold and valve assembly of the present invention.

Referring now to FIG. 4, and particularly FIGS. 5–6, valve 160 is shown with a bottom surface 161 thereof supported on shelf 133 of manifold member 131. Valve 160 includes valve inlet ports 162 which are disposed in fluid communication with fluid chamber 163 via fluid chamber outlet ports 169. The fluid chamber outlet port is supplied with air from conduit 140 as seen in FIG. 4. Valve 160 further includes valve outlet ports 164 which are aligned with manifold inlet ports 165 and operable for fluid communication therewith. As seen in FIG. 5, manifold outlet port 166 is disposed in fluid communication with nozzle 167. Nozzles 167 are thereafter aligned with the first plurality of orifices 104 to allow a pulse of compressed air to exit housing 101 to strike individual cutting devices and drive same, as will be described hereinafter. Valve mounting screws 168 threading secure valve 160 to manifold member 131. It should be understood that all ports or inlets may further include O-rings to enhance fluid communication integrity. For example, O-rings could be provided between bottom surface 161 of valve 160 and shelf 133 of manifold member 131.

Figure 7:
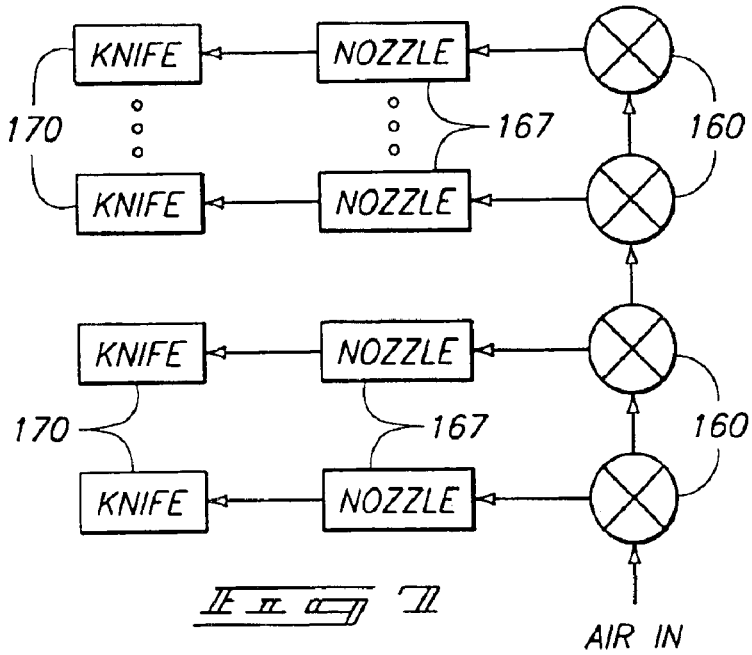
FIG. 7 is a greatly simplified schematic diagram of the manifold and valve assembly of the present invention and showing the cutting devices therewith.

FIGS. 6 and 7 illustrate a plurality of valves 160 which form an array that includes nozzles 167 and knives or cutting devices 170. The cutting devices 170 are earlier described and disclosed in Davis '702. The valves 160 are secured to upper shelf 133 of manifold member 131 as described with reference to FIG. 5. By placing the valves 160 and nozzles 167 proximate the cutting devices 170, and using air as the driving fluid, it has been discovered that the duration of a pulse of air is shortened to allow for driving a single cutting device. Accordingly, the increased selectivity and reliability for driving individual cutting devices alleviates the problems previously discussed regarding diminished product yields and quality. It should be understood that any number of valves 160 could be used in this invention with the corresponding array of nozzles 167 and cutting devices 170. An exemplary distance from nozzle 167 to a cutting device 170 is 7/16ths of an inch.

Figure 8:
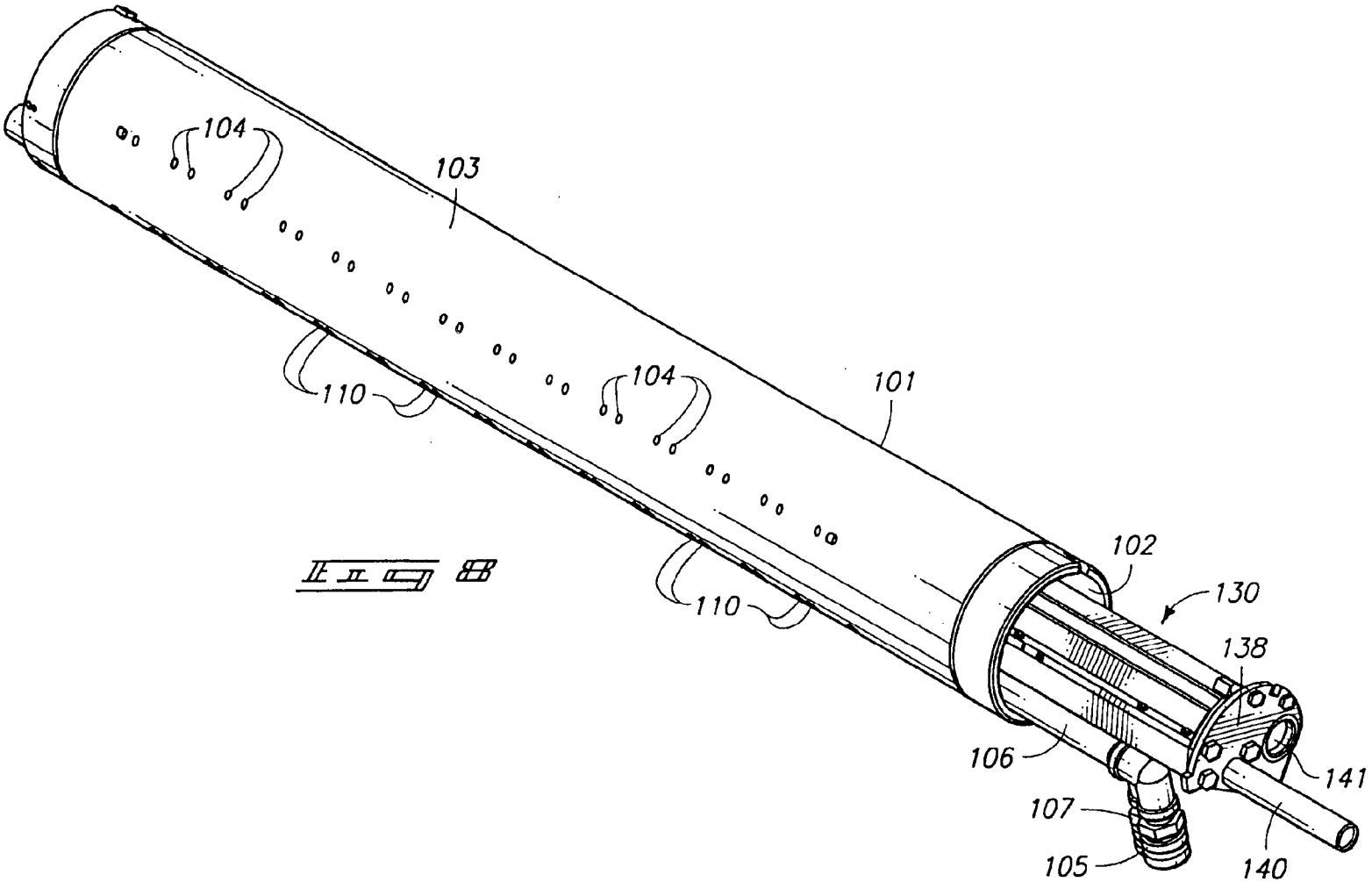
FIG. 8 is a partial perspective view of the FIG. 3 housing with the FIG. 4 manifold and valve assembly telescopingly received therein according to one aspect of the present invention.

Referring now to FIG. 8, manifold and valve assembly 130 is shown being telescopingly positioned substantially longitudinally within cavity 102 of cylindrical housing 101. The manifold assembly 130 is subsequently secured therein.

Referring now to FIGS. 9–12, additional structure of the cutting mechanism 100 is described. In an effort to prevent obscuring the invention at hand, all of the details germane to implementing the invention will be described, with other specific details understood to be incorporated by reference to Davis '702. Referring now to FIG. 9, the cutting mechanism 100 is shown without the manifold and valve assembly 130. FIG. 9 shows a plurality of cutting device support rings 180 which are operable to be rotatably mounted about the outer periphery 103 of the cylindrical housing 101. A plurality of cutting devices 170 are mounted for substantial radial movement on each cutting device support ring 180 (shown in FIG. 11). Each of the cutting devices 170 are disposed at angularly spaced increments about the cylindrical housing 101. A plurality of camming components 183 are positioned about the outer periphery 103 of the said cylindrical housing 101 and are secured against rotation adjacent the cutting device support rings 180. As illustrated, one camming component 183 is sanwiched between two cutting device support rings 180, except for the ends of cutting mechanism 100 where one camming component is located between one of the cutting device support rings 180 and one of end supports 181 and 182. The respective camming components 183 include tracking grooves 184 for receiving portions (not shown) of the cutting devices 170. The respective end supports 181 and 182 are positioned over each end of the cylindrical housing 101 to support same and are disposed laterally outwardly relative to the last cutting device support ring 180 and camming component 183 combination. Two bearings 187 at each end of the cutting mechanism 100 are housed in the respective end supports 181 and 182 to allow the respective support rings 180 to rotate over the outer periphery 103 of cylindrical housing 101. Laterally outwardly from end support 182 is a drive gear 188 which cooperates with a drive belt 189 such that the drive belt 189 is operatively coupled to conveyor drive 52 shown in FIG. 1 for rotatably driving the cutting mechanism 100. As such, end support 182 acts as a drive spacer for supporting and orienting the drive gear 188 and belt 189 relative the other components of cutting mechanism 100. Disposed operatively outwardly or endwardly relative to the drive gear 188 is an index disk 190 which will be described hereinafter.

Cutting wheel mechanism 100 further includes a plurality of tie rods 185 that extend through substantially aligned openings formed in the respective components of cutting mechanism 100 to secure the cutting wheel mechanism 100 together. Additionally, cutting wheel mechanism 100 further includes a plurality of dowel pins 186 secured in aligned openings between adjacent cutting device support rings 180. To increase processing speeds and capacity of the cutting wheel mechanism 100, the angular velocity (RPM) and length (measured from one end support 181 to the other 182) of the cutting mechanism 100 must correspondingly increase. Such increased speed and capacity causes the cutting mechanism 100 to axially twist during rotation thereby affecting the timing of driving the cutting devices 170. Accordingly, the dowel pins 186 secure the cutting device support rings 180 together to end supports 181 and 182 wherein the cutting mechanism 100 is held in alignment during rotation.

Referring now to FIG. 10, the cutting mechanism 100 is shown in an assembled condition with the manifold and valve assembly 130 received in the cutting mechanism 100.

Figure 11:
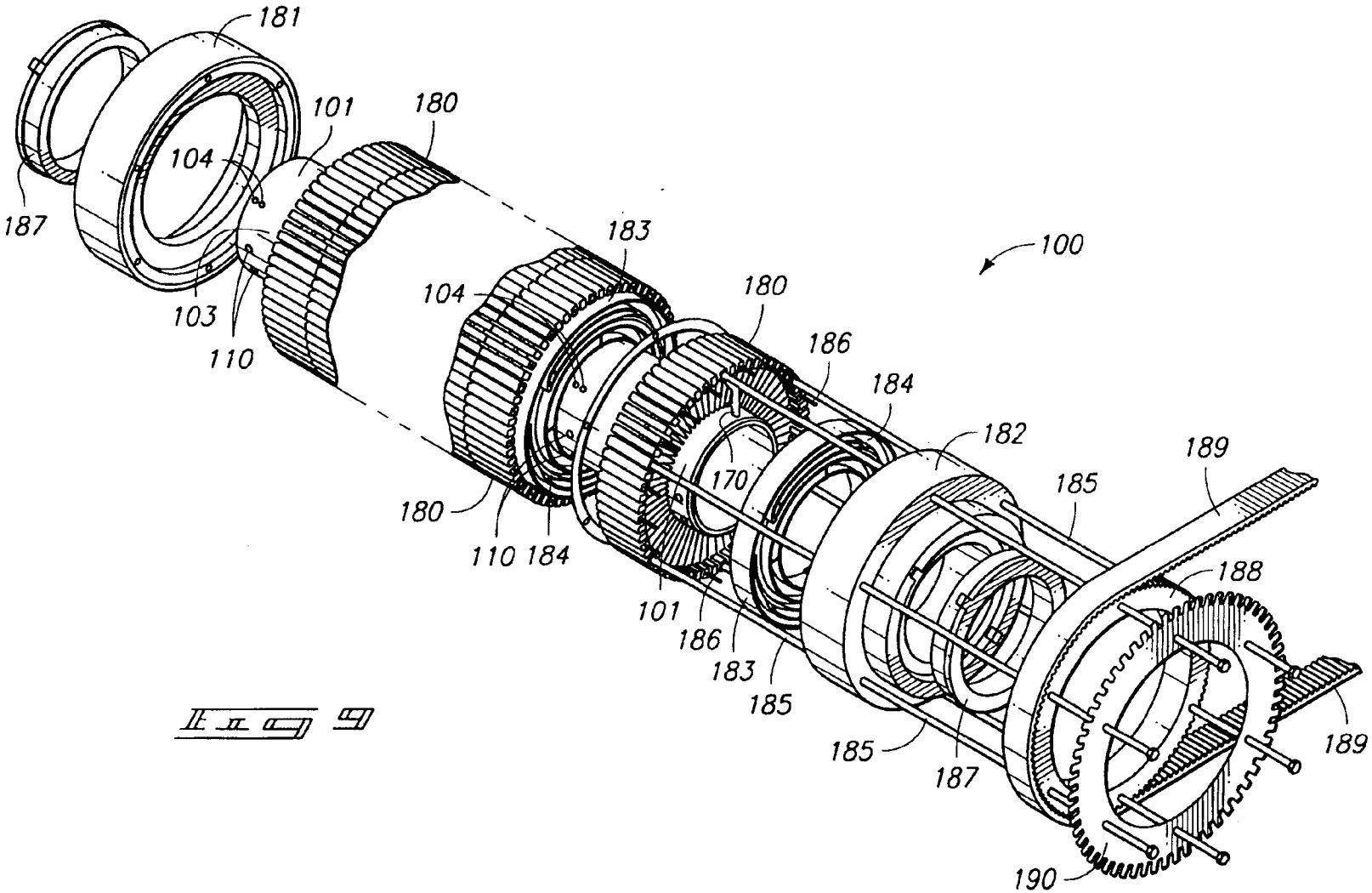
FIG. 11 is a fragmentary, vertical, sectional view of the cutting mechanism of the present invention without the manifold and valve assembly positioned therein, and illustrating positions of cutting instruments between a first retracted noncutting position and a second extended cutting position and which is taken from a position along line 11—11 of FIG. 10.
Figure 11:
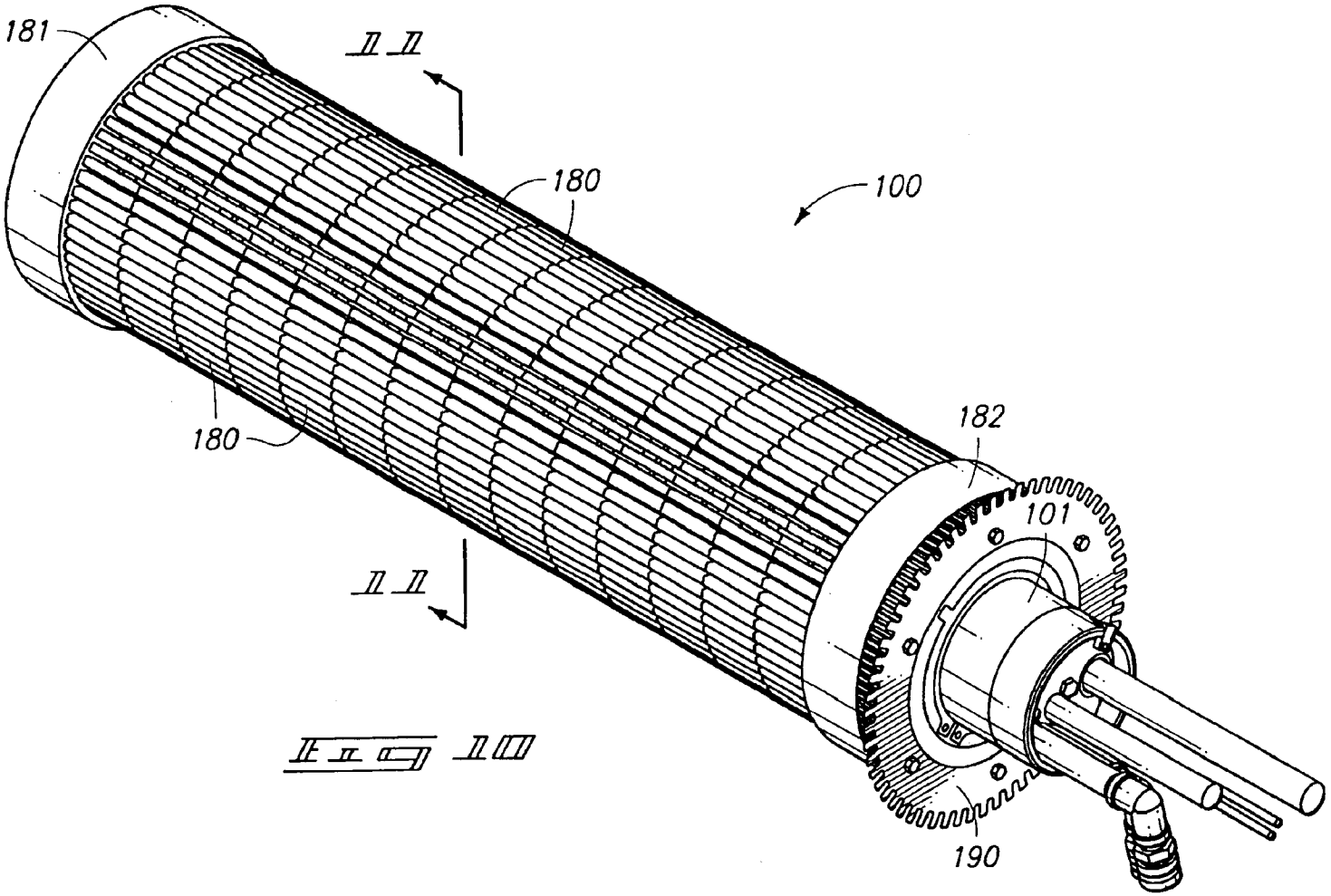
Figure 11:
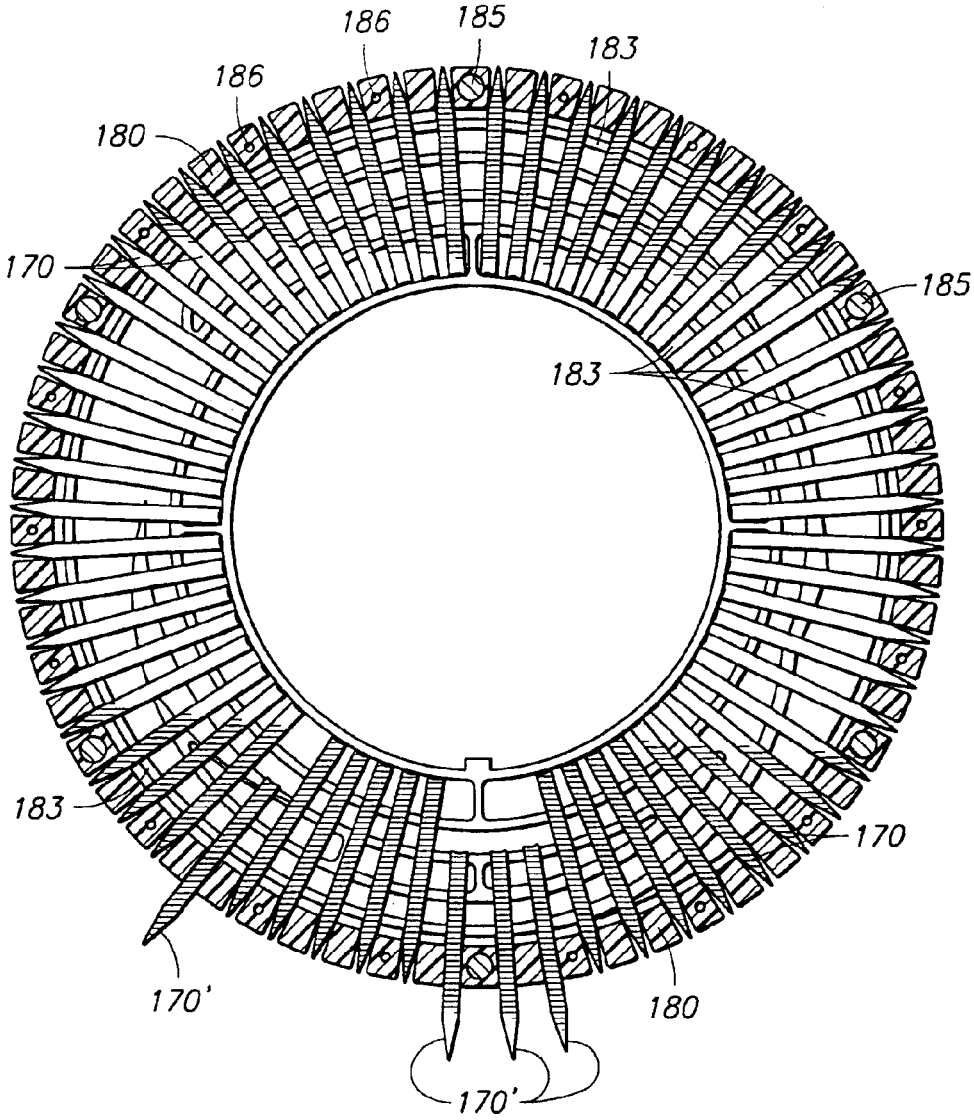

Referring now to FIG. 11, each cutting device 170 is moved along a path of travel from first retracted non-cutting position, and a second extended cutting position relative the cutting mechanism 100. With respect to this path of travel, cutting devices 170 that are referenced as 170' illustrate the second, extended cutting position, while the rest of the cutting devices 170 are located in the first retracted non-cutting position. As seen in FIG. 11, the camming components 183 guide the cutting devices 170 ' along the path of travel between the first and second positions selectively in reaction to receiving a pulse of compressed air from manifold and valve assembly 130. The camming components 183 provides a continual biasing force against the cutting devices 170. This force normally maintains the cutting devices 170 in the second extending cutting position 170' without the continued presence of any fluid. As will be recognized, forcing the respective cutting devices 170 into the second position 170' provides a cutting force to serve elongated articles as they pass by and under the cutting mechanism 100.

Spray bar assemblies 105 and 107 as shown in FIG. 3 provide water to the cutting mechanism 100, according to another aspect of the invention. In this regard, the respective spray bars deliver water at a given flow rate to the respective cutting devices 170, and cutting device support rings 180 to create a fluid induced adhesive force between the respective cutting devices 170 and cutting device support rings 180. In this aspect of the invention, the inventors have discovered that controlling the given flow rate of the water maintains or prevents the respective cutting devices 170 from indiscriminately moving from the first to the second extended cutting position due to the inertia (centrifugal) forces exerted on the respective cutting devices 170 as the cutting mechanism rotates. As noted earlier, this results in increased reliability and product yield.

Figure 12:
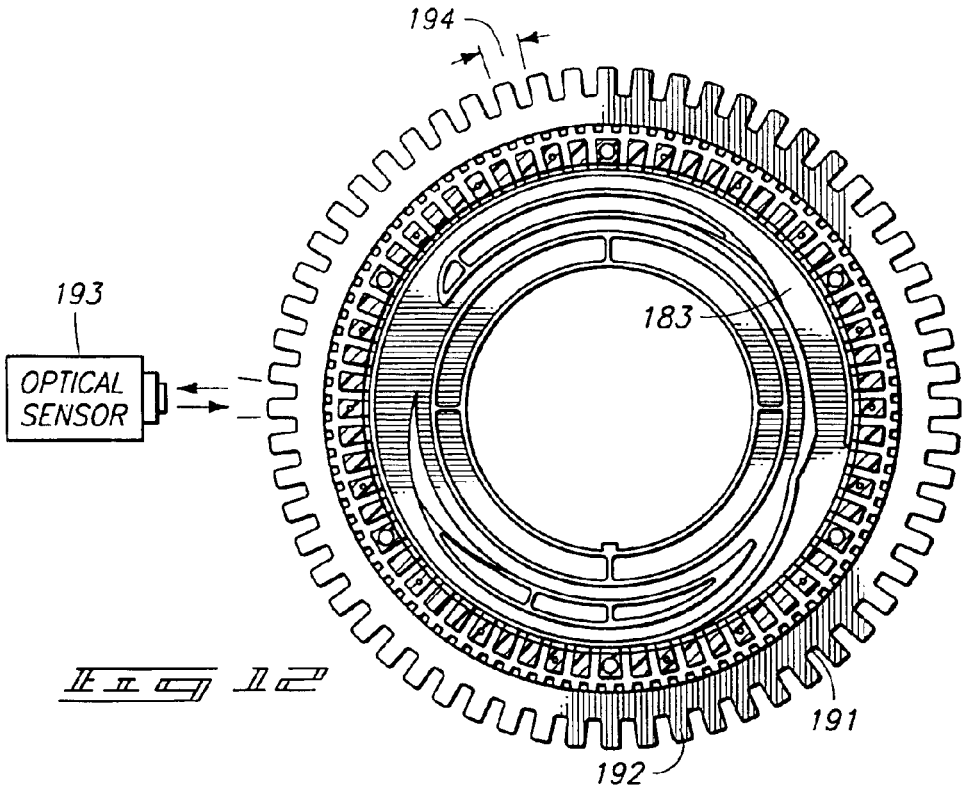
FIG. 12 is an end view of the cutting mechanism with the manifold and valve assembly removed and shown in a typical operational environment in combination with an optical sensor.

Referring now to FIG. 12, index disk 190 is secured to support rings 180 and operable for rotation therewith. The index disk includes a substantially round periphery 191 which is radially spaced from the outer periphery 103 of the housing 101. Index disk 190 further includes outwardly projecting features 192 which extend from the periphery 191, and which are disposed at angularly spaced increments about same. A sensor such as, for example an optical sensor 193, is disposed in sensing relation relative to the projecting features 192 of the index disk 190. The optical sensor establishes a timing index for determining the angular position of the cutting mechanism 100. This permits synchronizing the timing of actuation of the respective cutting devices 170. The optical sensor 193 is aligned to scan a region 194 which is occupied by the outwardly projecting features 192, and generate a signal corresponding to each projecting feature 192 that passes through the region 194.

Figure 13:
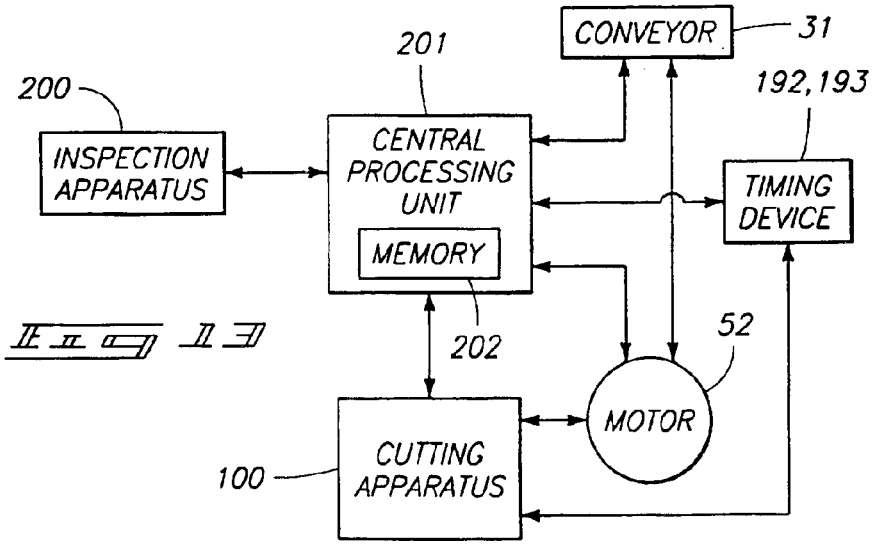
FIG. 13 is a greatly simplified schematic diagram of the control circuitry for an inspection and cutting apparatus shown in FIG. 1.
Figure 11:
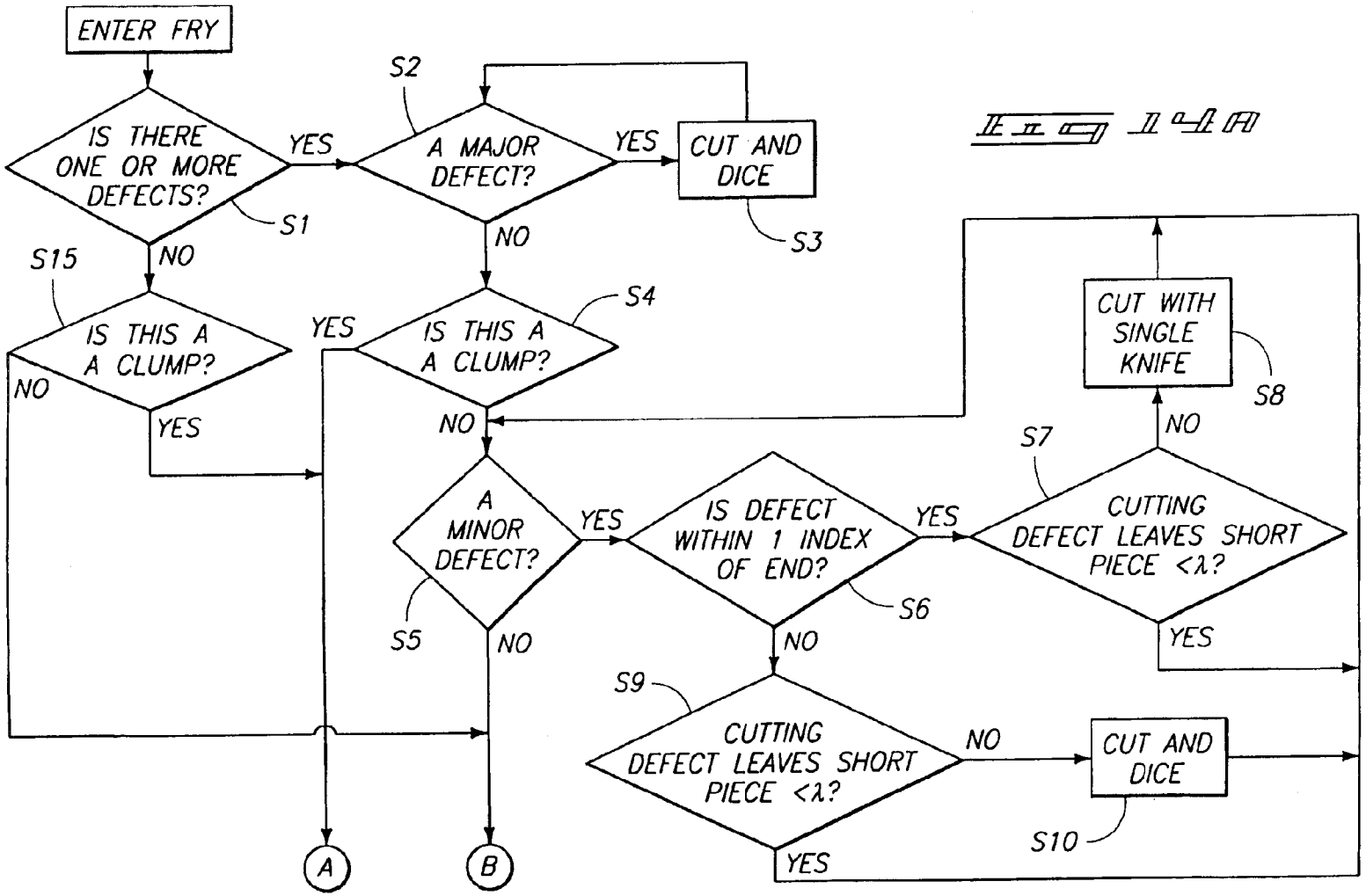
Figure 11B:
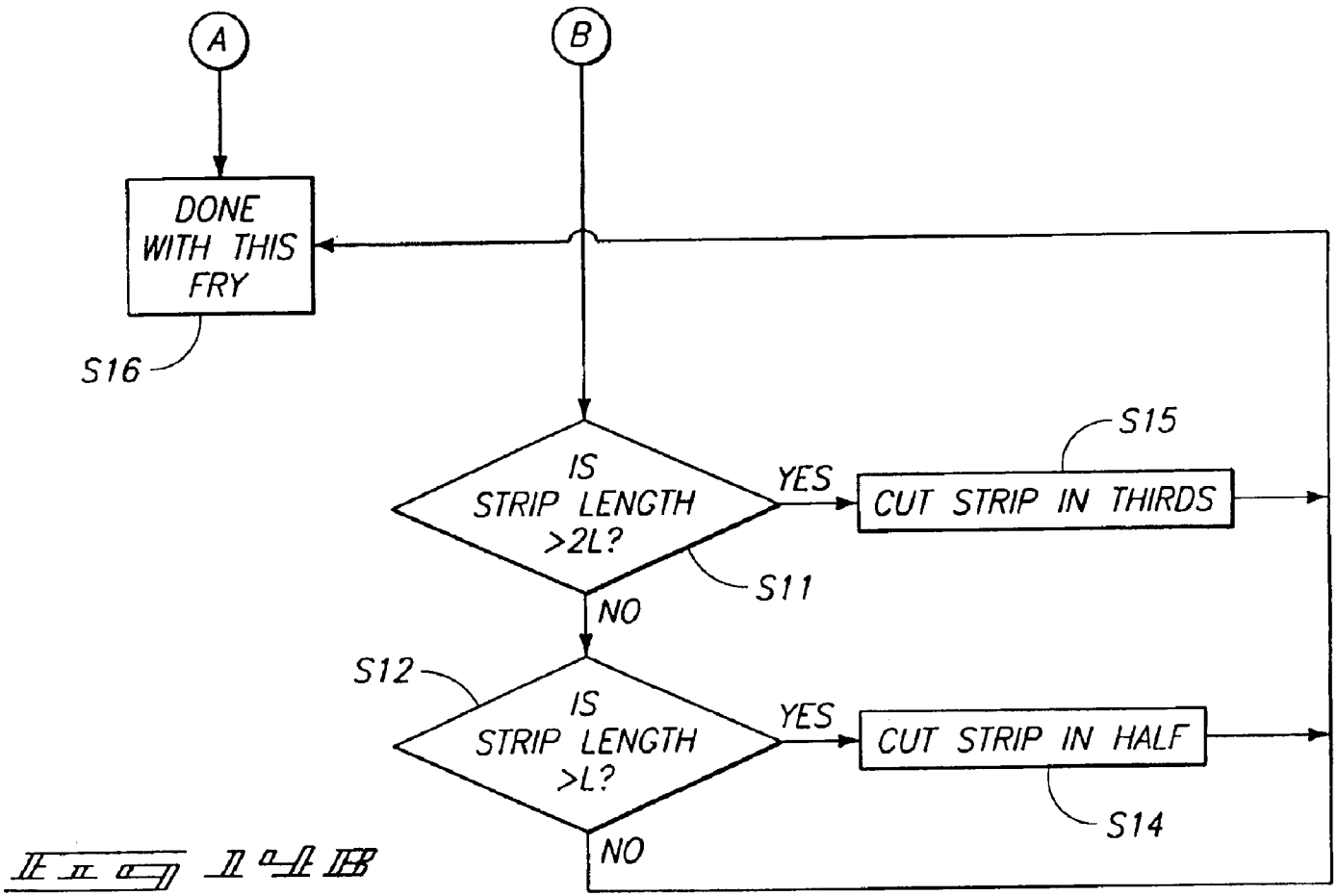

Referring now to FIG. 13, a high level flow chart for operating an inspection and cutting apparatus of the present invention is illustrated. An inspection apparatus or device 200 for use in the present invention generates electrical signals representative of the respective elongated articles. The inspection apparatus is operatively coupled to a central processing unit 201 having a memory 202. Central processing units are known in the art and will not be described in further detail. The present inspection apparatus is commercially available from Key Technology, Inc., 150 Avery, Walla Walla, Wash., 99362-1668. Timing device 192, 193 is operatively coupled in relation relative to signal transmitting to the central processing unit 201 and cutting apparatus 100 respectively. Still further, conveyor 31 is operatively coupled to central processing unit 201 and motor 52. Motor 52 is operatively coupled to cutting apparatus 100 and central processing unit 201.

Referring now to FIGS. 14A and 14B, an exemplary method is illustrated for length cutting and defect removal from a stream of moving elongated articles in accordance with one aspect of the present invention. It will be recognized that the following method is implemented by logic resident in the central processing unit 201.

In step S1, each of a plurality of elongated articles, for example a stream of french fries, enter for scanning by the inspection apparatus 200 and which determines if one or more defects are present in each of the elongated articles and, if not, proceeding to step S15 and, if so, proceeding to step S2.

In step S2, the method includes measuring the area of each defect in the respective elongated articles and determining if at least one defect measurement is greater than a first threshold value and, if not, proceeding to step S4 and, if so, proceeding to step S3. A defect measurement greater than the first threshold value is defined as a major defect for the purposes of this application. The first threshold value could be designated any value.

In step S3, the method includes sending a signal for activating multiple cutting devices 170 to cut and dice each defect from the elongated article which is greater than the first threshold value, and proceeding to step S4.

In step S4, the method includes determining from the scanning step S1 if one or more of the elongated articles are contacting one or more other elongated articles and, if not, proceeding to step S5 and, if so, proceeding to step S16. In this document, one or more other elongated articles contacting one another is defined as a clump.

In step S5, the method includes determining if any defect measurements from step S2 are greater than a second threshold value and, if not, proceeding to step S11 and, if so, proceeding to step S6. A defect measurement greater than the second threshold value is defined as a minor defect for the purposes of this document. The second threshold value could be designated as any value.

In step S6, the method includes determining if any defect found in step S5 is within a preset distance from an end of the elongated article and, if not, proceeding to step S9 and, if so, proceeding to step S7. The preset distance is defined as one timing index value for the purposes of this document. The timing index value is used to indicate the angular position of the cutting mechanism 100 for synchronizing the response of the valves 160 to activate a cutting device 170.

In step S7, the method includes determining if cutting the defect from the elongated article would leave the remaining elongated article with a length less than a third threshold value and, if not, proceeding to step S8 and, if so, proceeding to step S5. For the purposes of this document, the third threshold value is defined as a minimum length dimension of an elongated article, and could be designated as any value.

In step S8, the method includes sending a signal for activating one cutting device to remove the defect, and proceeding to step S5.

In step S9, the method includes determining if cutting the defect from the elongated article would leave any remaining elongated articles less than the third threshold value and, if not, proceeding to step S10 and, if so, proceeding to step S5.

In step S10, the method includes sending a signal for activating multiple cutting devices to cut and dice the defect from the elongated article, and proceeding to step S5.

In step S11, the method includes measuring the length of the elongated article from the scanning step S1 and, if a signal has been sent to activate any cutting devices, recalculating the length measurement as if the defect has been removed and then measuring the length of any remaining elongated articles except for the defect to be removed, and determining if the measured length is greater than two multiplied by a fourth threshold value and, if not, proceeding to step S12 and, if so, proceeding to step S13. For the purposes of this document, the fourth threshold value is defined as a maximum length dimension of an elongated article, and could be designated as any value.

In step S12, the method includes determining if the measured length is greater than the fourth threshold value and, if not, proceeding to step S16 and, if so, proceeding to step S14.

In step S13, the method includes sending a signal for activating the cutting devices to cut the elongated article into three sections with each section having a length comprising substantially the measured length divided by three and proceeding to step S16.

In step S14, the method includes sending a signal activating one cutting device to cut the elongated article substantially in half, and proceeding to step S16.

In step S15, the method includes determining from the scanning step (a) if one or more of the elongated articles are contacting one or more other elongated articles and, if not, proceeding to step S11 and, if so, proceeding to step S16.

In step S16, the method includes allowing the respective elongated articles to move along to the cutting devices.

Figure 15:
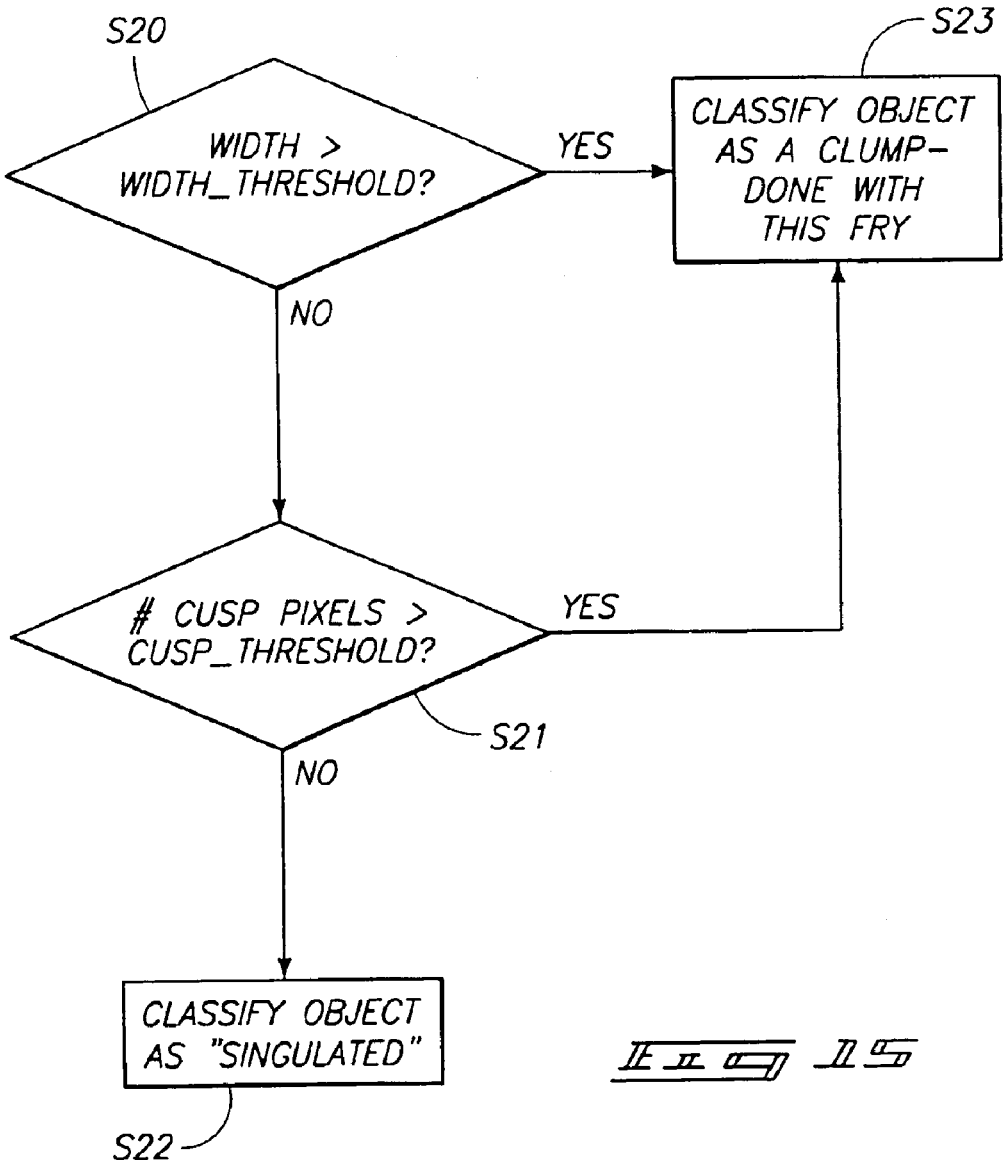
FIG. 15 is a flowchart illustrating a second logic method of the present invention and which is performed by the central processing unit of FIG. 13 to control the inspection and cutting apparatus of FIG. 1 for length cutting and defect removal of elongated articles.
Figure 11C:
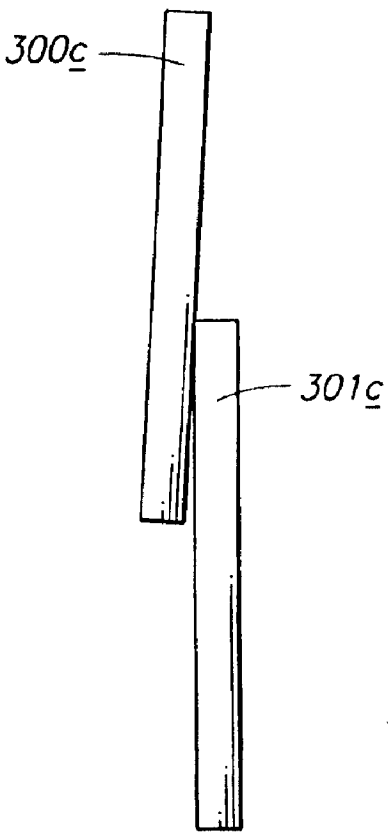
Figure 11B:
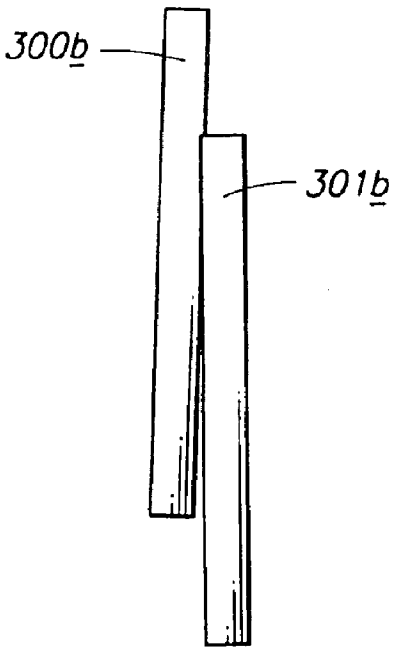
Figure 11A:
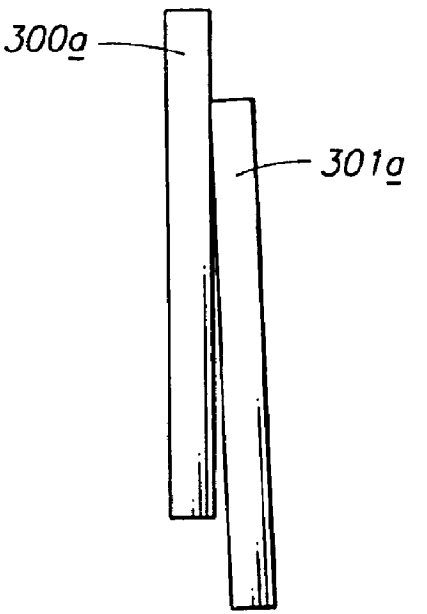
Figures 11A, 11B, 11C:
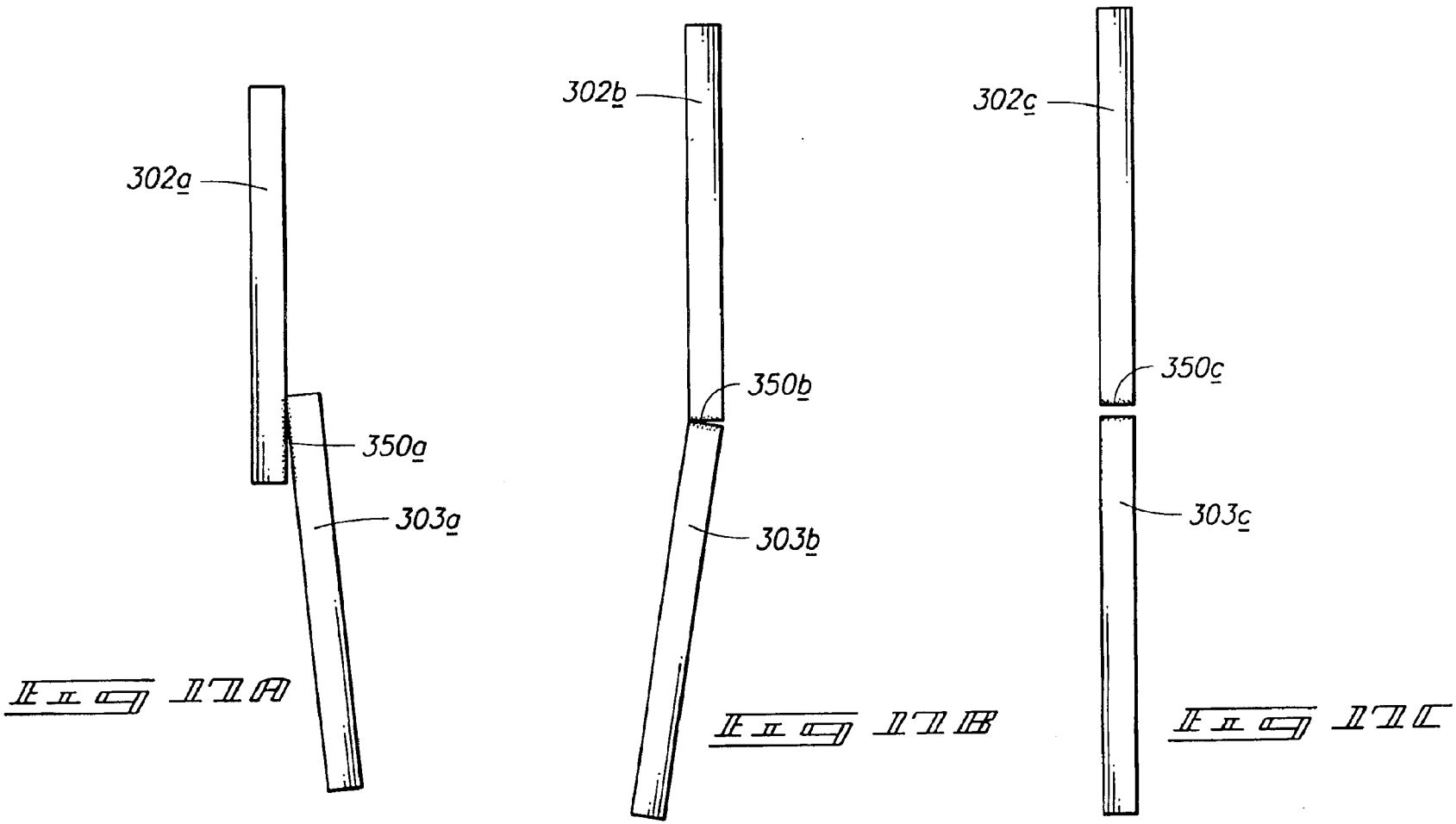
Figure 11C:
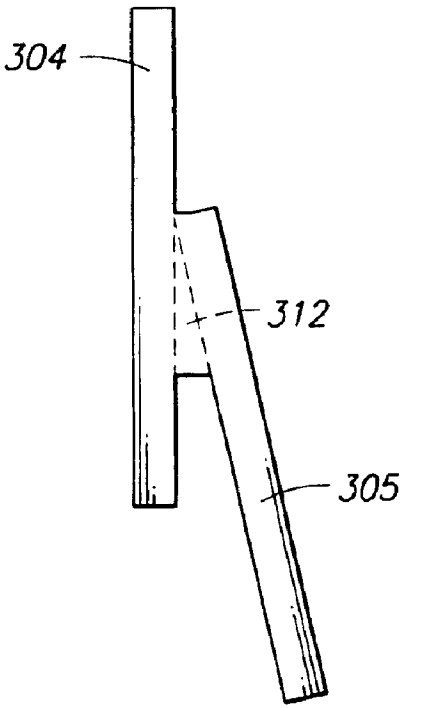
Figure 11B:
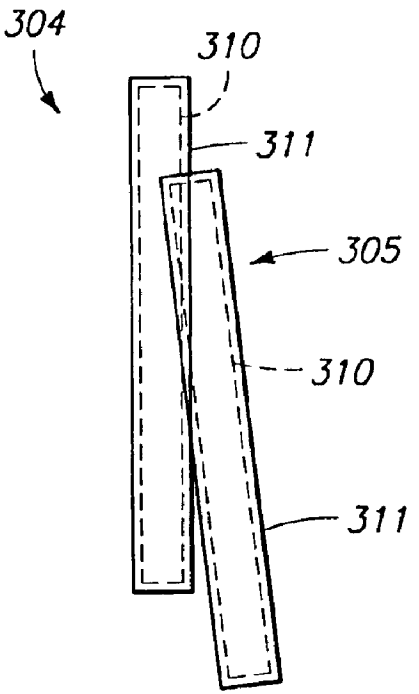
Figure 11A:
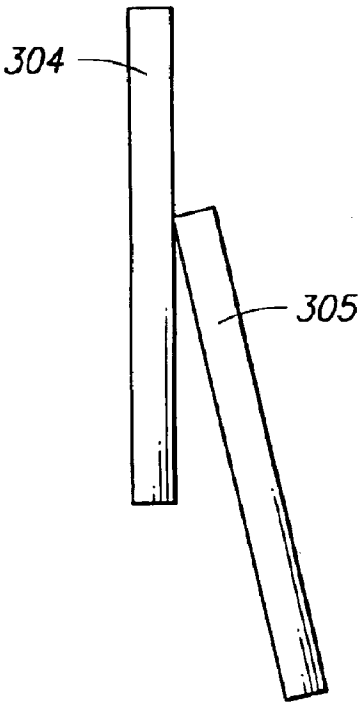
Figure 11E:
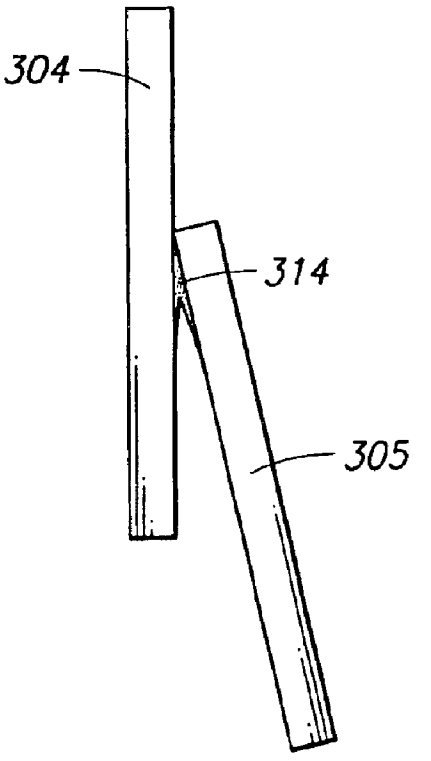
Figure 11D:
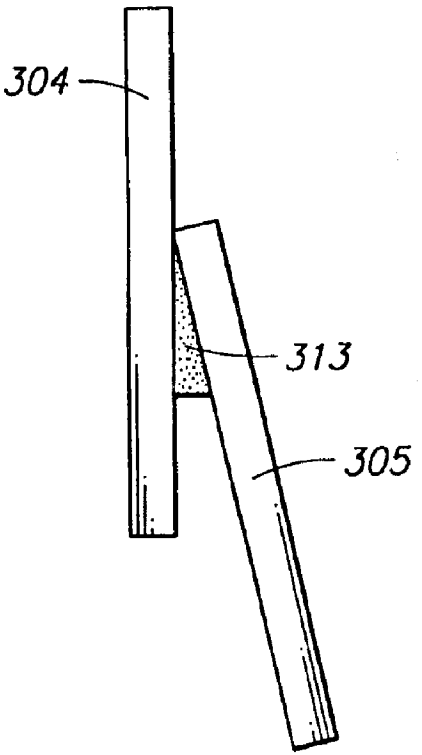

Referring now to FIG. 15, an another exemplary method is illustrated for length cutting and defect removal from a stream of moving elongated articles in accordance with another aspect of the present invention. It should be understood that this method is a more thorough development of steps S4 and S15 as seen in FIGS. 14A and 14B, and which relate to clump detection.

In step 520, the method includes scanning an elongated article by utilizing inspection apparatus 200 and determining a width of the elongated article and if any cusp pixels (defined hereinafter) are generated by the inspection apparatus 200, and comparing the width measurement to a fifth threshold value, and if the width measurement is greater than the fifth threshold value proceeding to step S23 and, if not proceeding to step S21. For the purposes of this document, the fifth threshold value is defined as a maximum width dimension of a single elongated article, and could be designated as any value.

In step 521, the method includes determining if the number of cusp pixels detected is greater than a sixth threshold value and, if not, proceeding to step S22 and, if so, proceeding to step S23. Excited sensors, for example optical sensors or pixels, in the inspection apparatus 200 are generated to form images. For the purposes of this document, cusp pixels are those pixels excited when two or more elongated articles are proximate one another. Furthermore, the cusp pixels could be defined as, for example, any images of article boundaries that form acute angles with other articles. The sixth threshold value is therefore a minimal number of cusp pixels detected that will not classify the image as a clump. The sixth threshold could be given any value.

In step 522, the method includes classifying the image of the elongated article as singulated, that is, not a clump, and proceeding with the steps described previously with reference to FIGS. 14A and 14B.

In step 523, the method includes classifying the image of the elongated article as a clump, and proceeding with the steps previously described with respect to FIGS. 14A and 14B.

Referring now to FIGS. 16A–C, situations are illustrated where images of elongated articles generated by the inspection apparatus 200, such as fries 300A–C and 301A–C, would be classified as clumps of fries by using only the width threshold value according to one aspect of the present invention. For efficiency reasons, the width of an object is not measured directly from the image. That is, width is computed from object area and length where the number of pixels excited to form an image is counted. For example, the length of the object is determined by computing the distance from the first pixel seen, or excited, for imaging the object to the last pixel seen for imaging the object. The width of the object is estimated as by the formula: width=area divided by length.

Referring to now FIGS. 17A–C, situations are illustrated where images of elongated articles, such as fries 302A–C and 303A–C, would be classified as clumps of fries by using the cusp pixel threshold value according to another aspect of the present invention. The slight darkening of the fry boundaries 350A–C forming the acute angles would be the cusp pixels generated. In FIG. 17C, cusp pixels 350C are generated due to the proximity of the images formed.

Referring now to FIGS. 18A–E, an exemplary case is illustrated for further explaining the steps involved in generating cusp pixels. Cusp pixels are generated using the low-level image processing hardware (the inspection apparatus 200) sold by Key Technology, Inc, and previously discussed. The cusp pixels are generated by using binary morphological operations. In other words, morphological operations such as erosions and dilations are performed on images with 1-bit per pixel. In particular, a "closed filter" is applied to pixels not representing background images (equivalent to an "open filter" for pixels representing background). The open filter can be used to identify the pixels belonging to thin objects. The closed filter can be used to identify small holes in objects, or where two separate objects are near each other.

Referring now to FIG. 18A, fries 304 and 305 are illustrated as a clump. Referring to FIG. 18B, fries 304 and 305 are dilated from a first image boundary 310 to a second image 311. Referring to FIG. 18C, the dilated images are eroded as shown. A dilation operation followed by an erosion operation is known as a close filter. The original background image (generally represented by numeral 312 in phantom) between fries 304 and 305 is illustrated as being filled (i.e. closed). Referring now to FIG. 18D, the difference between the original object and the "closed object" is represented by the closed region 313. Referring to FIG. 18E, cusp pixels 314 are generated at the boundaries of the original images that are adjacent to the closed region 313 of FIG. 18D.

What is claimed is:

1. A cutting wheel assembly for cutting elongated articles, comprising:

a substantially cylindrical housing defining a longitudinally disposed cavity and which has a substantially circular outer periphery;

a plurality of cutting device support rings rotatably mounted about the outer periphery of the cylindrical housing;

a plurality of cutting devices mounted for radial movement on each cutting device support ring, and disposed at angularly spaced increments about the cylindrical housing, and wherein each cutting device is radially moveable between a first, retracted non-cutting position, and a second, extended cutting position, and wherein rotation of the respective cutting device support rings creates inertia forces on the cutting devices such that the cutting devices are encouraged to move to the second, extended cutting position;

an assembly of conduits and valves operatively connected to the cylindrical housing for selectively directing a pulse of a first fluid at a preselected angular position against individual cutting devices to urge the respective cutting devices substantially radially outwardly from the first, retracted non-cutting position, to the second, extended cutting position;

an assembly of fluid conduits operatively connected to the cylindrical housing for delivering a second fluid at a given flow rate to the respective cutting devices and cutting device support rings to create a fluid induced adhesive force between the respective cutting devices and cutting device support rings, and wherein the second fluid prevents the respective cutting devices from indiscriminately moving from the first position to the second extended cutting position due to the inertia forces exerted on the respective cutting devices; and a plurality of camming components mounted on the outer periphery of the cylindrical housing and located adjacent the cutting device support rings, the camming components comprising tracking grooves for receiving portions of the respective cutting devices and which operate to guide the respective cutting devices as they individually travel between the first and second positions, and further maintaining the respective cutting devices in the second extended cutting position without a continued presence of the first fluid, and wherein the respective cutting devices cut the elongated articles when located in the second position.

2. A cutting wheel assembly as claimed in claim 1 wherein the assembly of conduits and valves comprises a manifold having an outer surface, and a plurality of pneumatic valves supported on the outer surfaces of the manifold, and wherein the manifold and valves are disposed in fluid communication with a compressed air source.

3. A cutting wheel assembly as claimed in claim 1 wherein the first fluid comprises ambient air and the second fluid comprises water.

4. A method for length cutting and removing detects from a stream of moving elongated articles, comprising:

providing an apparatus including an inspection device for scanning the stream of moving elongated articles at a given location and generating electrical signals characteristic of those elongated articles which contact one another, characteristic of defects in the respective elongated articles, and characteristic of dimensions of the elongated articles; and including a plurality of cutting devices independently moveable between a retracted non-cutting position to an extended cutting position for severing the elongated articles, and which are positioned downstream from the inspection device; and including control circuitry operatively coupling the inspection device to the plurality of cutting devices, and which selectively activates at least one of the plurality of cutting devices causing it to move to the extended cutting position to cut selected elongated articles; and (a) scanning each elongated article and determining if one or more defects are present in each of the elongated articles and, if not, proceeding to step (o) and, if so, proceeding to step (b);

(b) measuring an area of each defect in the respective elongated articles and determining if at least one defect measurement is greater than a first threshold value and, if not, proceeding to step (d) and, if so, proceeding to step (c);

(c) sending a signal for activating multiple cutting devices to cut and dice each defect from the elongated article which is greater than the first threshold value, and proceeding to step (d);

(d) determining from the scanning step (a) if one or more of the elongated articles are contacting one or more other elongated articles and, if not, proceeding to step (e) and, if so, proceeding to step (q);

(e) determining if any defect measurements from step (b) are greater than a second threshold value and, if not, proceeding to step (k) and, if so, proceeding to step (f);

(f) determining if any defect found in step (e) is within a preset distance from an end of the elongated article and, if not, proceeding to step (l) and, if so, proceeding to step (g);

(g) determining if cutting the defect from the elongated article would leave the remaining elongated article with a length less than a third threshold value and, if not, proceeding to step (h) and, if so, proceeding to step (e);

(h) sending a signal for activating one cutting device to remove the defect, and proceeding to step (e);

(i) determining if cutting the defect from the elongated article would leave any remaining elongated articles less than the third threshold value and, if not, proceeding to step (j) and, if so, proceeding to step (e);

(j) sending a signal for activating multiple cutting devices to cut and dice the defect from the elongated article, and proceeding to step (e);

(k) measuring a length of the elongated article from the scanning step (a) and, if a signal has been sent to activate any cutting devices, recalculating length as if the defect has been removed to provide a measured length of any remaining elongated articles except for the defect to be removed, and determining if the measured length is greater than two multiplied by a fourth threshold value and, if not, proceeding to step (l) and, if so, proceeding to step (m);

(l) determining if the measured length is greater than the fourth threshold value and, if not, proceeding to step (q) and, if so, proceeding to step (n);

(m) sending a signal for activating the cutting devices to cut the elongated article into three sections with each section having a length comprising substantially the measured length divided by three and proceeding to step (q);

(n) sending a signal activating one cutting device to cut the elongated article substantially in half, and proceeding to step (q);

(o) determining from the scanning step (a) if one or more of the elongated articles are contacting one or more other elongated articles and, if not, proceeding to step (k) and, if so, proceeding to step (q);

(q) allowing the respective elongated articles to move along to the cutting devices.

5. A method as claimed in claim 4 wherein the scanning step comprises generating electrical signals which define boundaries of the elongated article as contrasted against a background; and wherein performing step (d) further comprises determining a width of the elongated article and comparing the width to a fifth threshold value, and if the width is greater than the fifth threshold value proceeding to step (q).

6. A method as claimed in claim 5 wherein the determining of the width of the elongated article comprises determining an area and a length of the elongated article, and dividing the area by the length.

7. A method as claimed in claim 6 wherein the scanning step comprises exciting sensors which contrast the elongated article against the background and which permits the determining of the width, and wherein the area is determined by measuring a duration of sensors excited with respect to the elongated article.

8. A method as claimed in claim 4 wherein the scanning step comprises generating electrical signals which define boundaries of the elongated article as contrasted against a background and wherein performing step (d) further comprises:

(i) determining a width of the elongated article and comparing the width to a fifth threshold value, and if the width is greater than the fifth threshold value, proceeding to step (q) and, if not, proceeding to step (ii);

(ii) determining if the scanning step (a) generates signals of elongated article boundaries forming acute angles and, if not, proceeding to step (e) and, if so, proceeding to step (q).

9. An inspection and cutting apparatus for length cutting and defect removal of a stream of moving elongated articles, the apparatus comprising:

an inspection device for generating electrical signals representative of the elongated articles;

a cutting mechanism comprising a plurality of cutting devices for selectively cutting the elongated articles;

a conveyor for supporting and carrying the elongated articles past the inspection device and cutting mechanism, the cutting mechanism being located downstream from the inspection device;

control circuitry operatively coupling the inspection device to the cutting mechanism for processing electrical signals generated by the inspection device and activating the cutting mechanism in response to the electrical signals;

a conveyor drive operatively coupling and controlling the conveyor and which is responsive to the control circuitry; and wherein the cutting mechanism further comprises a substantially cylindrical housing defining a longitudinally disposed cavity and having a substantially circular outer periphery; a plurality of cutting device support rings rotatably mounted for movement about the outer periphery of the cylindrical housing, the plurality of cutting devices mounted for substantially radial movement on each cutting device support ring, and disposed at predetermined angularly spaced increments about the cylindrical housing, and wherein each cutting device is radially moveable between a first, retracted non-cutting position, and a second, extended cutting position; a manifold and valve assembly mounted in the longitudinally disposed cavity and oriented proximate the respective cutting devices for selectively directing a pulse of fluid at a preselected angular position against individual cutting devices to urge the respective cutting devices substantially radially outwardly from the first, retracted non-cutting position, to the second, extended cutting position; and a plurality of camming components mounted on the outer periphery of the cylindrical housing and located adjacent the cutting device support rings, the respective camming components comprising tracking grooves for receiving portions of the cutting devices and which guide the respective cutting devices between the first and second positions, and which further maintains the respective cutting devices in the second, extended cutting position without a continued presence of the fluid, and wherein the respective cutting devices cut the elongated articles when in the second; and wherein the conveyor further comprises a plurality of individual lanes adjacent one another to receive the respective elongated articles, and a plurality of disks are borne by the conveyor and which extend upwardly between the lanes and which are substantially parallel to the movement of the conveyor.

10. An apparatus as claimed in claim 9 wherein the conveyor comprises twenty-eight lanes.

* * * * *

UNITED STATES PATENT AND TRADEMARK OFFICE

CERTIFICATE OF CORRECTION

PATENT NO. : 6,923,098 B2
APPLICATION NO. : 10/466718
DATED : August 2, 2005
INVENTOR(S) : McGarvey et al.

It is certified that error appears in the above-identified patent and that said Letters Patent is hereby corrected as shown below:

Col. 11, line 16, please delete "520," after "In step" and insert --S20,---.

Col. 11, line 27, please delete "521," after "In step" and insert --S21,---.

Col. 11, line 44, please delete "522," after "In step" and insert --S22,---.

Col. 11, line 48, please delete "523," after "In step" and insert --S23,---.

Col. 12, line 1, please delete "to now" after "Referring" and insert --now to--.

Col. 13, line 8, claim 1, please delete "first position to the second" after "from the" and insert --first, retracted non-cutting position to the second,--.

Col. 13, lines 17-18, claim 1, please delete "first and second positions," after "from the" and insert --first, retracted non-cutting position and the second, extended cutting position,--.

Col. 13, line 22, claim 1, please delete "second position." after "in the" and insert --second, extended cutting position.--.

Col. 13, line 33, claim 4, please delete "detects" after "removing" and insert --defects--.

Col. 16, line 24, claim 9, please delete "first and second positions," after "between the" and insert --first, retracted non-cutting position and the second, extended cutting position,--.

Signed and Sealed this

Nineteenth Day of February, 2008

JON W. DUDAS
*Director of the United States Patent and Trademark Office*

UNITED STATES PATENT AND TRADEMARK OFFICE

CERTIFICATE OF CORRECTION

PATENT NO. : 6,923,098 B2
APPLICATION NO. : 10/466718
DATED : August 2, 2005
INVENTOR(S) : Ken McGarvey, Robert Earl Jones and Maurice J. Hunking It is certified that error appears in the above-identified patent and that said Letters Patent is hereby corrected as shown below:

Col. 16, lines 28-29, claim 9 -
Replace "devices cut the elongated articles when in the second; and"
With --devices cut the elongated articles when in the second position; and--

Signed and Sealed this

Twenty-seventh Day of May, 2008

JON W. DUDAS
*Director of the United States Patent and Trademark Office*